US006497392B1

(12) United States Patent
Perkins

(10) Patent No.: US 6,497,392 B1
(45) Date of Patent: Dec. 24, 2002

(54) ERGONOMIC FOREARM AND WRIST SUPPORT DEVICE

(76) Inventor: Jason L. Perkins, 4453 Thornwood Ave., Salt Lake City, UT (US) 84123

( * ) Notice: Subject to any disclaimer, the term of this patent is extended or adjusted under 35 U.S.C. 154(b) by 0 days.

(21) Appl. No.: 09/944,355

(22) Filed: Aug. 31, 2001

(51) Int. Cl.[7] ..... B68G 5/00
(52) U.S. Cl. ..... 248/118; 248/918
(58) Field of Search ..... 248/118, 118.1–118.3, 248/118.5, 918

(56) References Cited

U.S. PATENT DOCUMENTS 2,895,469 A * 7/1959 Regley
4,169,466 A * 10/1979 Wong
5,197,699 A * 3/1993 Smith
5,445,349 A 8/1995 Hart ..... 248/118
5,467,950 A * 11/1995 Dumitru
5,990,870 A 11/1999 Chen et al. ..... 345/163
6,135,399 A 10/2000 Savoie et al. ..... 248/118

* cited by examiner

*Primary Examiner*—Alvin Chin-Shue
(74) *Attorney, Agent, or Firm*—Henderson & Sturm LLP

(57) ABSTRACT

An ergonomically designed forearm and wrist support device (10) including a wrist support unit (11) and a forearm support unit (12) arranged in a generally L-shaped configuration wherein each of the support units (11) (12) comprises an elongated generally rectangular housing member (20) (20') having a base element (21) (21') and a cover element (22) (22') provided with a plurality of apertures (23) (23') dimensioned to receive a plurality of roller balls (28) (28') (28") arranged in a particular pattern to provide support to a user's wrist and forearm while manipulating a computer mouse.

10 Claims, 1 Drawing Sheet

ERGONOMIC FOREARM AND WRIST SUPPORT DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of ergonomic supports for computer users in general and in particular to an ergonomic roller device that specifically supports the user's wrist and forearm while operating a computer mouse.

2. Description of Related Art

As can be seen by reference to the following U.S. Pat. Nos. 5,467,950; 6,135,399; 5,445,349; and 5,990,870, the prior art is replete with myriad and diverse computer oriented support devices for a user's hand and wrist.

While all of the aforementioned prior art constructions are more than adequate for the basic purpose and function for which they have been specifically designed, they are uniformly deficient with respect to their failure to provide a simple, efficient, and practical support device that focuses specifically in supporting a computer user's wrist and forearm in an ergonomic fashion.

While it is indisputable that a computer user's wrist should be ergonomically supported either during typing or maneuvering a mouse, the prior art has failed to recognize that the computer operator's forearm is used extensively in the manipulation of the mouse to access different areas of a computer monitor.

As a consequence of the foregoing situation, there has existed a longstanding need among computer users for a new and improved ergonomically designed wrist and forearm support device; and, the provision of such a construction is the stated objective of the present invention.

BRIEF SUMMARY OF THE INVENTION

Briefly stated, the ergonomically designed forearm and wrist support device that forms the basis of the present invention comprises in general a wrist support unit and a forearm support unit which are aligned in a generally L-shaped configuration.

As will be explained in greater detail further on in the specification, both the wrist support unit and the forearm support unit include generally elongated rectangular housing members and wherein each of the housing members includes a base element and a cover element provided with a plurality of apertures dimensioned to receive a plurality of roller balls rotatably suspended within the respective housing members by an internal framework member.

In addition, each of the support units has a particular array and/or alignment of roller balls including both small and large diameter roller balls which are provided to ergonomically support different portions of a computer user's wrist and forearm while manipulating a computer mouse.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
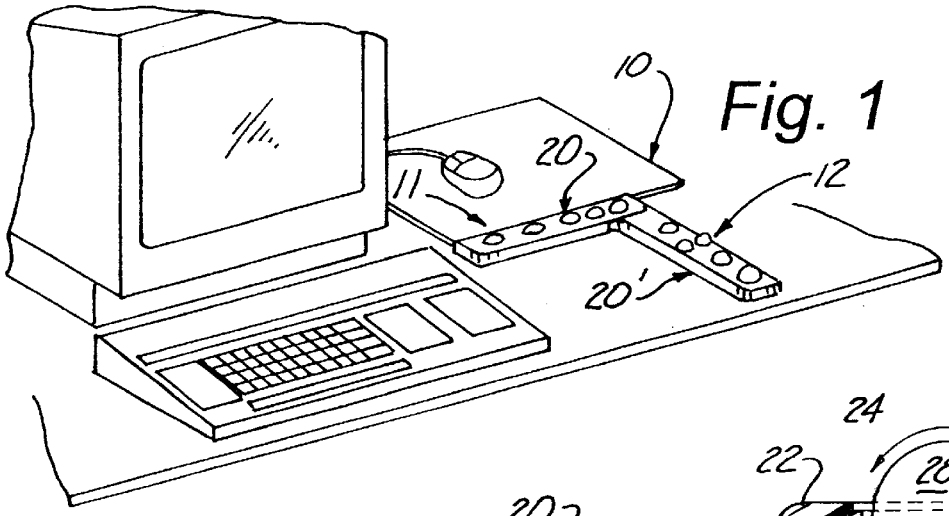
FIG. 1 is a perspective view of the ergonomically designed forearm and wrist support device in use.

As can be seen by reference to the drawings, and in particularly to FIG. 1, the ergonomic forearm and wrist support device that forms the basis of the present invention is designated generally by the reference number 10. The device 10 comprises in general a wrist support unit 11 and a forearm support unit 12 which are aligned in a generally L-shaped configuration to accommodate a user's wrist and forearm. These units will now be described in seriatim fashion.

Prior to embarking on a detailed description of the wrist support unit 11 and the forearm support unit 12, it should first be noted that both of these units have the same basic construction that varies only in the configuration of the housing members 20 and 20' and the arrangement and size of the roller balls.

Figure 2:
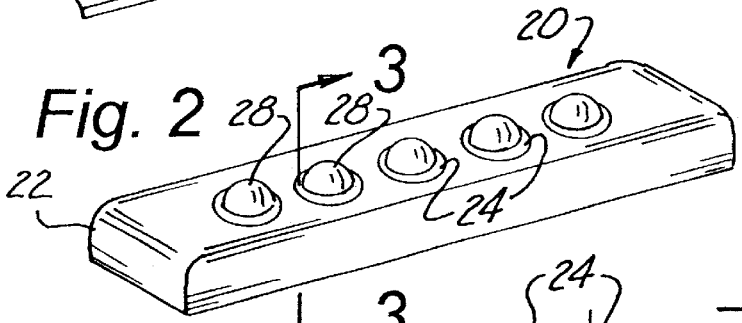
FIG. 2 is an isolated perspective view of the wrist support unit.
Figure 3:
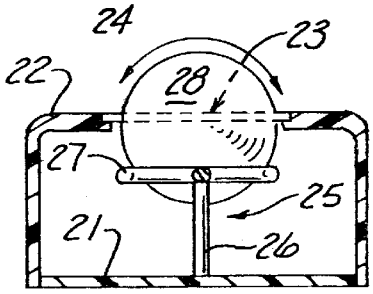
FIG. 3 is a cross-sectional view taken through line 3—3 of FIG. 2.
Figure 4:
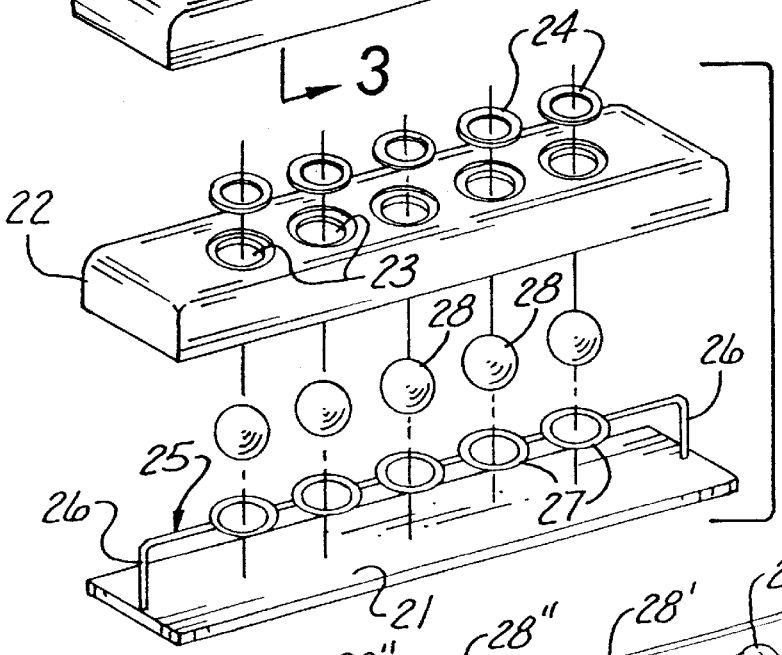
FIG. 4 is an exploded perspective view of the wrist support unit.

As shown in FIGS. 2 through 4, the wrist support unit 11 comprises a generally elongated rectangular housing member 20 having rounded comers and including a base element 21 and a cover element 22 provided with a plurality of recessed apertures 23 dimensioned to receive a like plurality of bearing collars 24 whose purpose and function will be described presently.

In addition, as can best be seen by reference to FIGS. 3 and 4, the base element 21 is further provided with a framework member 25 having a plurality of downwardly depending support legs 26 and a plurality of horizontally disposed and aligned support rings 27 dimensioned to rotatably receive a plurality of roller balls 28.

Figure 5:
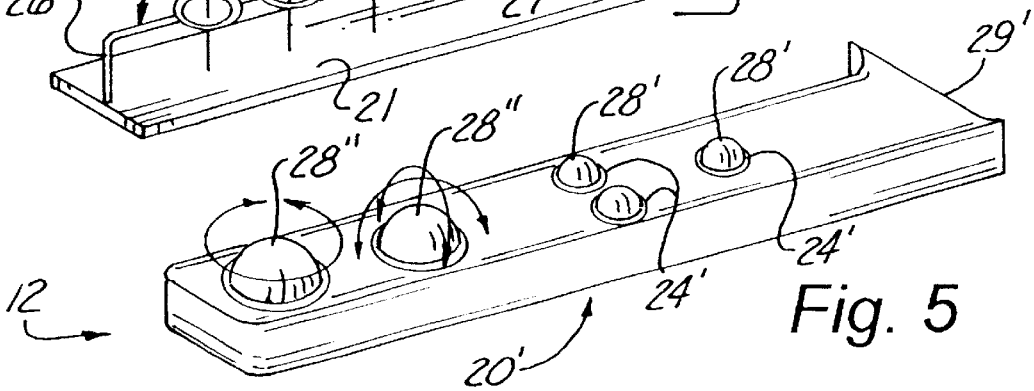
FIG. 5 is an isolated perspective view of the forearm support unit.

Turning now to FIGS. 2 and 4, it can be seen that in the wrist support unit 11, all of the plurality of roller balls 28 are of the same size and equally spaced from one another; whereas, in the forearm support unit 12 depicted in FIG. 5, some of the plurality of roller balls 28 in the wrist support unit 11 and other of the plurality of roller balls 28" are substantially larger.

In addition, the spacing of the roller balls 28' 28" in the forearm support unit 12 is substantially different than the spacing of the roller balls 28 in the wrist support unit 11 as will be explained presently.

As shown in FIGS. 2 and 4, the roller balls 28 in the wrist support unit 11 are aligned in a row along the longitudinal axis of the housing member 20; whereas, as shown in FIG. 5, the smaller roller balls 28' are arranged in a generally triangular arrangement with the base of the triangle being disposed proximate the midpoint of the housing member 20' of the forearm support unit 12 and the point of the triangle disposed toward the inboard end 29' of the housing member 20'.

Furthermore, the enlarged roller balls 28" are spaced from one another proximate the outboard end of the housing member 20 to provide an elevated movable support surface for the intermediate portion of a user's forearm.

Turning now to FIGS. 1 and 5, it can be seen that the inboard end 29' of the housing member 20' is provided with flared corners 30' and 31' which are oriented perpendicular to one another and contoured so as to provide an aesthetically pleasing juncture between the wrist support unit 11 and the forearm support unit 12 in forming the L-shaped configuration of the device 10.

It should also be appreciated at this juncture that the base member 21 and the cover member 22, respectively, of both the wrist support unit 11 and the forearm support unit 12 can be formed integrally with one another rather than as two independent components in achieving the L-shaped configuration.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. An ergonomically designed forearm and wrist supporting device comprising:

a wrist support unit including a first elongated generally rectangular housing member having a base element and a cover element provided with a first plurality of apertures rotatably receiving a first plurality of roller balls; and, a forearm support unit including a second elongated generally rectangular housing member having a base element and a cover element provided with a second plurality of apertures rotatably receiving a second plurality of roller balls wherein said first and second housing members are of approximately equal length forming with one another a generally L-shaped configuration.

2. The support device as in claim 1; wherein, said first plurality of roller balls is aligned along the longitudinal axis of the first housing member.

3. The support device as in claim 2; wherein, said first plurality of roller balls are equally spaced from one another.

4. The support device as in claim 3; wherein, said first plurality of roller balls are all of the same size.

5. The support device as in claim 4; wherein, said second plurality of roller balls include at least some roller balls that are the same size as the uniform size of the first plurality of roller balls.

6. The support device as in claim 5; wherein, the second plurality of roller balls also include at least some roller balls that are greater in size than the uniform size of the first plurality of roller balls.

7. The support device as in claim 6; wherein, the larger sized roller balls in said second plurality of roller balls are disposed toward the end of the second housing member that is furthest from the juncture of the first and second housing members.

8. The support device as in claim 7; wherein, the larger sized roller balls are disposed along the longitudinal axis of the second housing member.

9. The support device as in claim 8; wherein, the roller balls in the second plurality of roller balls that are the same size as said first plurality of roller balls are disposed on the second housing member at a location that is proximate to, but spaced from, the juncture of the first and second housing members.

10. The support device as in claim 9; wherein, the roller balls on the second housing member that are disposed proximate to, but spaced from the juncture of the first and second housing members are arranged in a generally triangular configuration.

* * * * *